United States Patent [19]

Tanner

[11] 3,952,332

[45] Apr. 27, 1976

[54] APRON

[76] Inventor: Opal B. Tanner, 802 W. Chambers, Cleburne, Tex. 76031

[22] Filed: Mar. 17, 1975

[21] Appl. No.: 558,853

[52] U.S. Cl. ..... 2/48
[51] Int. Cl.[2] ..... A41B 13/10
[58] Field of Search ..... 2/48, 49 R

[56] References Cited

UNITED STATES PATENTS

| | | | |
|---|---|---|---|
| 1,513,513 | 10/1924 | London | 2/48 |
| 2,617,103 | 11/1952 | Westgarth | 2/48 |
| 2,897,505 | 8/1959 | Lipscomb | 2/48 |
| 3,231,898 | 2/1966 | Yablon | 2/48 |

*Primary Examiner*—Alfred R. Guest
*Attorney, Agent, or Firm*—Howard I. Podell

[57] ABSTRACT

An apron for laundry use formed on the front section with a pouch for carrying wash items. The apron is formed as a continuous unit with the bottom of the apron folded about the front of the apron to form the walls of the pouch. A separate pouch for carrying of clothespins is also mounted on the apron, which is fitted with straps for fastening about the user.

1 Claim, 2 Drawing Figures

APRON

SUMMARY OF THE INVENTION

My invention is an apron for laundry use formed on the front section with a pouch for carrying wash items. The apron is formed as a continuous unit with the bottom of the apron folded about the front of the apron to form the walls of the pouch. A separate pouch for carrying of clothespins is also mounted on the apron, which is fitted with straps for fastening about the user.

A user, wearing my invention, may carry wash to be hung on a line in the pouch of the apron, permitting the free use of both hands for the hanging of individual wash items on the line.

BRIEF DESCRIPTON OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
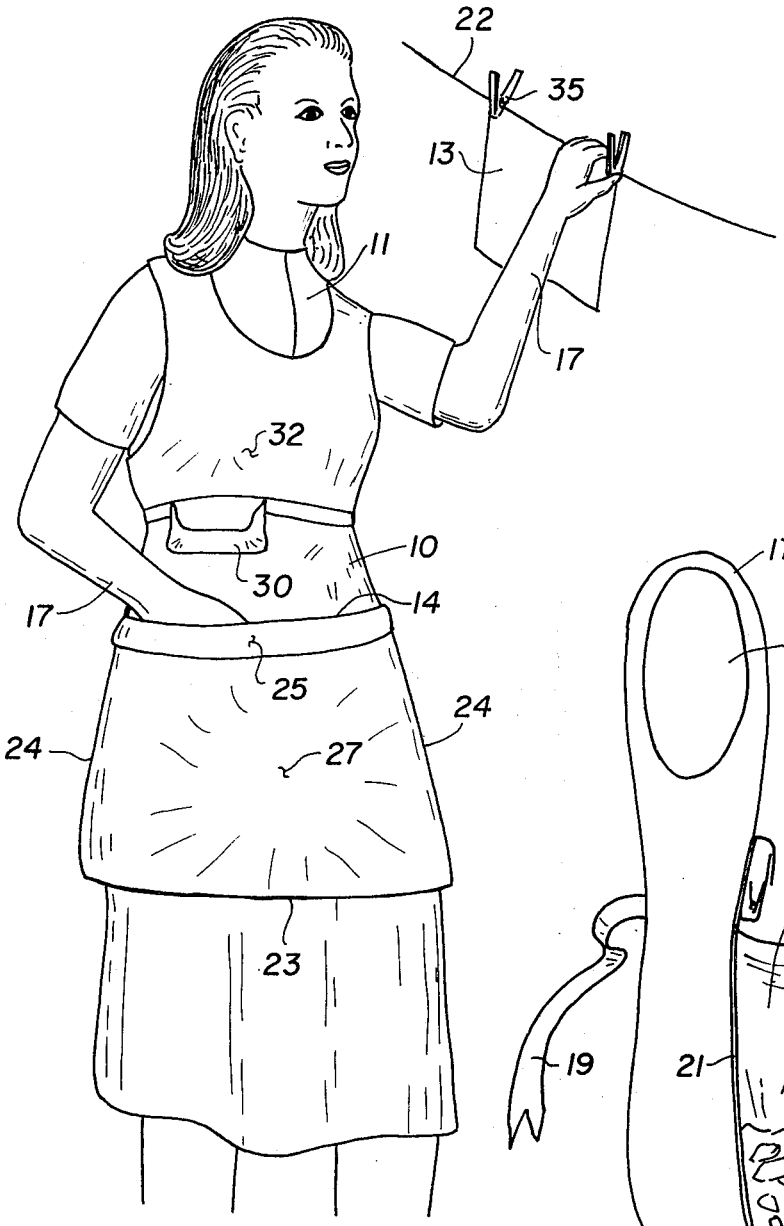
FIG. 1 is a perspective view of the invention in use.
Figure 2:
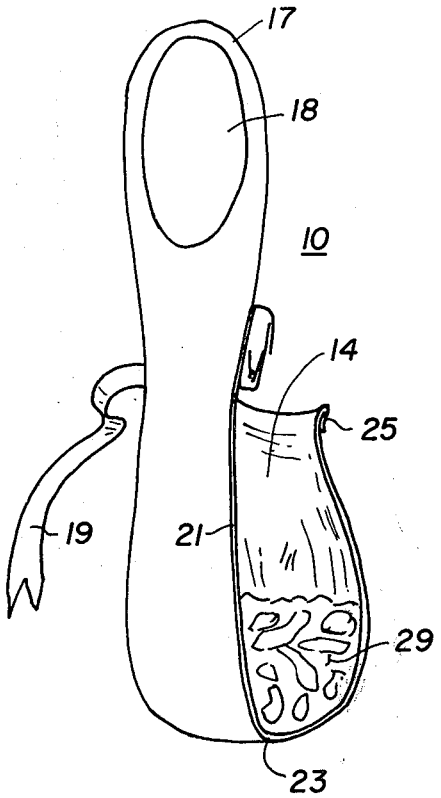
FIG. 2 is a sectional perspective view of the invention.

Turning now descriptively to the drawings, in which similar reference characters denote similar elements throughout the several views, FIGS. 1–2 illustrate the apron 10 which is formed of a continuous sheet 21 of flexible waterproof material with a circular shaped cut-out section 18 bounded by a shaped neck strap 17 to fit about the neck of the user 11 to which one or more side straps 19 are attached.

The bottom portion of the apron 10 is formed as an open pouch 14, with the sheet 21 forming the apron folded externally about itself along the bottom border 23 of the apron and with the sides 24 of the pouch 14 bonded together. The top external lip 25 of the pouch may be externally folded over the external front side 27 of the pouch 14 to form a rounded top edge to the pouch for ease in inserting wet wash 29 inside of the pouch.

A pocket 30 is fastened to the external front side 32 of the apron above the pouch 14 to provide for storage of clothespins 35 with which to hang an item 13 of wash 29 on a clothesline 22.

The apron 10 permits the user to freely employ both arms 17 in hanging wash items 13 while carrying the remainder of the unhung wash 29 in pouch 14.

Since obvious changes may be made in the specific embodiment of the invention described herein, such modificaions being within the spirit and scope of the invention claimed, it is indicated that all matter contained herein is intended as illustrative and not as limiting in scope.

Having thus described the invention, what I claim as new and desire to secure by Letters Patent of the United States is:

1. An apron for use in hanging wash items on a clothesline, said apron formed on its front with a continuous open pouch extending the full width of the apron, for the carrying of wash items to be hung on a line, said apron and pouch formed of a continuous sheet of flexible waterproof material, said sheet externally folded about the bottom border of the apron to form the pouch, with the side edges of the pouch bonded to the front of the apron, together with a pocket formed on the apron front, located above the mouth of the pouch of a size to contain clothespins, said pouch formed with a lip folded over the mouth of the pouch and extending over the front of the pouch to form a rounded front top pouch edge for ease in inserting wash items into the pouch.

* * * * *